United States Patent [19]

Kiesling et al.

[11] Patent Number: 4,584,502

[45] Date of Patent: Apr. 22, 1986

[54] ELECTRIC INCANDESCENT LAMP

[75] Inventors: Manfred Kiesling, Würselen, Fed. Rep. of Germany; Volker Kuhnert, Kerkrade, Netherlands

[73] Assignee: U.S. Philips Corporation, New York, N.Y.

[21] Appl. No.: 753,349

[22] Filed: Jul. 2, 1985

Related U.S. Application Data

[63] Continuation of Ser. No. 671,808, Nov. 15, 1984, abandoned, which is a continuation of Ser. No. 553,424, Nov. 21, 1983, abandoned, which is a continuation of Ser. No. 294,865, Aug. 21, 1981, abandoned.

[30] Foreign Application Priority Data

Sep. 13, 1980 [DE] Fed. Rep. of Germany ..... 3034595

[51] Int. Cl.[4] ..... H01J 7/44

[52] U.S. Cl. ..... 315/64; 313/315; 313/316; 313/333; 315/82; 307/10 LS

[58] Field of Search ..... 315/64; 313/315, 316, 313/333

[56] References Cited

U.S. PATENT DOCUMENTS

| | | | |
|---|---|---|---|
| 2,146,593 | 2/1939 | Roper | 313/269 |
| 2,198,919 | 4/1940 | Prideaux | 313/315 |
| 2,335,168 | 11/1943 | Bingley | 313/269 |
| 2,465,106 | 3/1949 | Lund | 313/315 |
| 3,027,481 | 3/1962 | Baber et al. | 313/315 |
| 4,052,638 | 10/1977 | Love et al. | 313/315 |
| 4,180,757 | 12/1979 | Distler | 313/315 |
| 4,208,603 | 6/1980 | Graves et al. | 313/333 |
| 4,296,351 | 10/1981 | Kimball | 313/316 |
| 4,441,051 | 4/1984 | Thomas | 313/315 |

*Primary Examiner*—Harold Dixon
*Attorney, Agent, or Firm*—David R. Treacy

[57] ABSTRACT

An electric incandescent lamp having a bead mount and a filament which extends transversely to the lamp axis. Current supply wires in the pinch seal lie in a plane which encloses an angle of at least 45° with the axis of the filament.

21 Claims, 10 Drawing Figures

ELECTRIC INCANDESCENT LAMP

Figure 1:
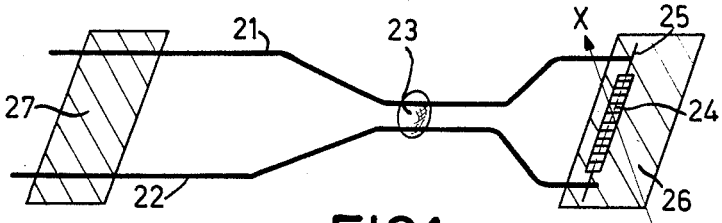

This is a continuation, of application Ser. No. 671,808, filed Nov. 15, 1984 now abandoned which in turn is a continuation of Ser. No. 553,424, filed Nov. 21, 1983, now abandoned; which in turn is a continuation of Ser. No. 294,865, filed Aug. 21, 1981 and now abandoned.

The invention relates to an electric incandescent lamp having a lamp envelope which has an axis of symmetry and a pinch seal provided with a lamp cap, in which lamp envelope at least one helically wound filament is stretched linearly transversely to the axis of the lamp envelope and is connected to current supply conductors which are passed through the pinch seal, which current supply conductors are secured together inside the lamp envelope by an electrically insulating member which is supported by said current supply conductors.

Such lamps are generally used in motor cars, for example, as a stop light, tail-light or blinker light. In these lamps the filament is mounted in the lamp envelope at a comparatively large distance from the pinch seal. Therefore the mount of the lamp is comparatively long. The mount is the assembly of the current supply conductors in as far as these extend inside the lamp envelope, and the electrically insulating member which connects said conductors and which as a rule is a bead, a beam or a disk of glasss or ceramic.

As a result of their application said incandescent lamps are subject to vibration and shocks to a considerable extent. In addition, the resonant frequencies of the filament overlap those of the mount so that superimposed vibrations occur. This results in fracture of the filament before the computed lifetime has been reached.

In motor cars, incandescent lamps are nearly always mounted with the axis of the lamp envelope horizontal. This is associated with the available possibilities of connecting the lamp holders to the motor cars. The lamp holders are furthermore mounted in such a position that the filament of a lamp placed therein lies in a horizontal plane. In order to achieve this there exists agreement between motor car manufacturers and lamp manufacturers in order that the lamp cap be provided in the correct position relative to the filament.

Motor car lamps, both when in operation and when extinguished, experience shocks and vibration which are directed substantially vertically and thus are directed at an right angle with the filament axis. When an operating lamp experiences shocks and vibration in the axial direction of the filament, the pitch of the turns of the filament would locally become larger and elsewhere smaller. Adjacent turns may contact each other and be short-circuited. The remaining turns will then be overloaded, which would result in premature failure of the lamp. For that reason motor car lamps are used with the filament horizontal so that the shocks and vibrations act substantially perpendicularly to the axis of the filament.

It is the object of the invention to provide electric incandescent lamps which are suitable for use in motor vehicles and which have a considerably increased resistance to shocks and vibration.

According to the invention this object is achieved in a lamp of the kind mentioned in the opening paragraph in that the current supply conductors in the pinch seal lie in a plane and the axis of the filament makes an angle of at least 45° with the said plane.

The mount of the kind used in the lamp according to the invention, that is one with a current supply wire situated inside the lamp envelope with an insulator supported by said conductors, is hereinafter referred to a bead mount.

In the lamp according to the invention the bead mount is twisted along its length through an angle from 45° to 135° such that the axis of the filament makes an angle of at least 45° with the plane in which the current supply conductors in the pinch seal are situated. The twist of the mount results in a resonant frequency considerably shifted with respect to the resonant frequency of the filament. As a result of this a considerably improved resistance to shocks and vibration is obtained.

It is to be noted that U.S. Pat. No. 4,180,757 discloses a telephone switchboard lamp having a shock resistance which is improved with respect to such lamps of a conventional construction. The improvement has been obtained by placing the filament with its axis in the direction of possible shocks instead of transversely thereto. This arrangement of the filament has been realized by twisting the plane in which the current supply wires extend inside the lamp over an angle of 90°. The improvement of said telephone lamp is said to be based on the recognition that a helicoidal member can be exposed to shocks better in the axial direction than in a direction at right angles thereto.

In a telephone lamp the conditions to which the lamp is exposed, however, differ essentially from those of a motor car lamp. A telephone lamp may be provided in a pushbutton of a switch which experiences a shock when the pushbutton, after the switch has been released and the current circuit through the lamp has been interrupted, springs back to its normal (unoperated) position and strikes against a backstop. At the instant the button strikes the backstop, a shock is imparted to the filament of the lamp, but no current is passing through the lamp anymore and hence no overload of the filament takes plate if several turns of said filament contact each other. In contrast therewith motor car lamps experience shocks while in operation.

The known telephone lamp furthermore has an stem mount, that is to say, inside the lamp envelope a glass member rigidly connected to the lamp envelope extends over by far the greater part of the length of the envelope, from the free end of which glass member the current supply wires extend into the lamp envelope. These wires are much shorter than the glass member. Due to their small length, their rigid fastening in the lamp stem, the relative stiffness of these wires vibration is not a problem under normal circumstances.

Further, in contrast with motor car lamps, telephone lamps are not exposed to vibration. The object of the known telephone lamps according to the U.S. Pat. No. 4,180,757 therefore is not to reinforce the suspension of the filament in the lamp envelope but to change the position of the filament with respect to the direction of shocks. Said change results in a changed position of the filament in the operating condition of the lamp too.

In the lamp according to the invention on the contrary, the position of filament in normal operation in a motor vehicle is with the axis of the filament in the usual horizontal position, as any other position would shorten the life of the lamp. The measure taken in this lamp has for its result that the suspension of the filament is more rigid.

The difference in construction between the telephone lamp according to the U.S. Pat. No. 4,180,757 and the motor car lamp according to the invention is also expressed in the position of the lamp cap with respect to the filament. In the telephone lamp according to the U.S. Pat. No. 4,180,757 the filament is rotated over 90° relative to the electric contact of the lamp cap as compared with conventional telephone lamps. In the lamp according to the invention, however, the filament is in the same position with respect to the electrical contact of its lamp cap as conventional lamps for the same purpose. When a conventional lamp in a motor vehicle is exchanged for a lamp according to the invention, the filament of the lamp in accordance with the invention has the same (horizontal) position as the filament of a conventional lamp.

Thus the cited United States patent could by no means tend to solve the problem of the prior art in the manner of the lamp according to the invention.

In the embodiment of the lamp in accordance with the invention the current supply conductors extend between the pinch seal and the electrically insulating member in a substantially flat plane. The position of the electrically insulating member may be chosen to be such that the resonant frequencies of the parts of the current supply conductors between the filament and said insulating member and those of the filament itself differ considerably from each other.

As the angle between the axis of the filament and the plane in which the current supply conductors between the pinch seal and the insulating member extend approaches closer to 90°, so said plane in the normal operating condition of the filament will become more and more vertical and an ever-increasing component of the shocks and vibrations becomes located in said plane. The electrically insulating member and the part of the current supply conductors between said member and the pinch seal then form a more and more rigid assembly which will not vibrate when used in motor vehicles.

For further rigidity, according to a further embodiment of the invention, additional supporting means, such as wires may be provided between the electrically insulating member and the pinch seal.

The incandescent lamp according to the invention may have two filaments extending parallel to each other, for combination example, for stoplight and taillight applications. In this case the four current supply wires in the pinch seal lie in a flat plane and are held in an elongate electrically insulating member, while their sections between insulating member and filaments are twisted into two, for example parallel, respective planes.

A further embodiment of a lamp in accordance with the invention has two filaments extending, for example, parallel to each other and the four current supply wires of which lie in the plane of the pinch seal and are held in a disk-shaped electrically insulating member while bent into a square in such manner that their sections between said member and the filament extend in two flat planes.

Figure 2:
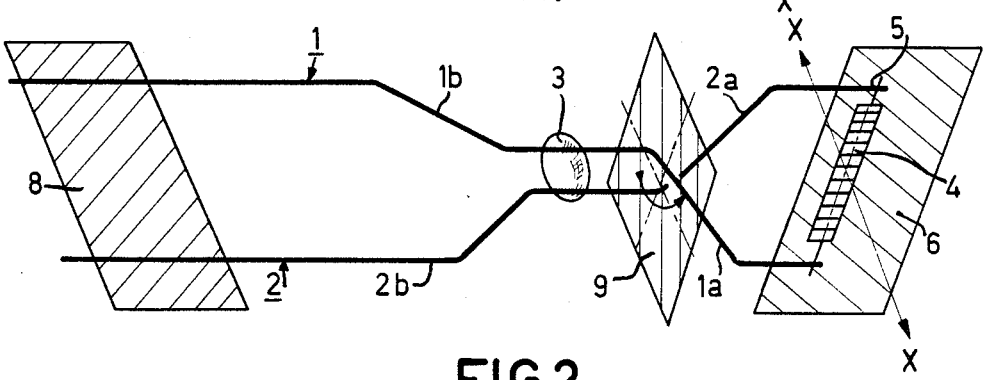
Figure 3:
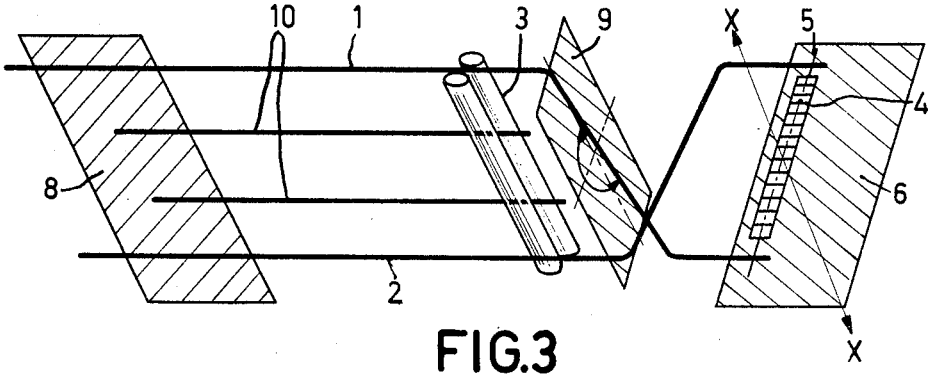
Figure 4:
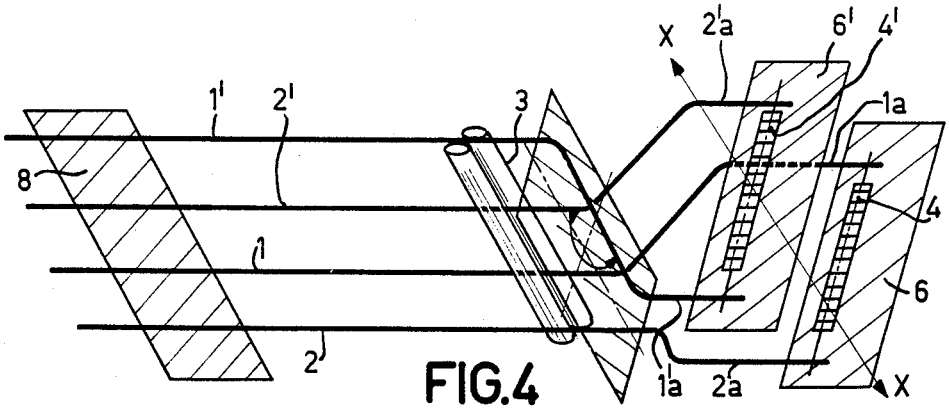
Figure 5:
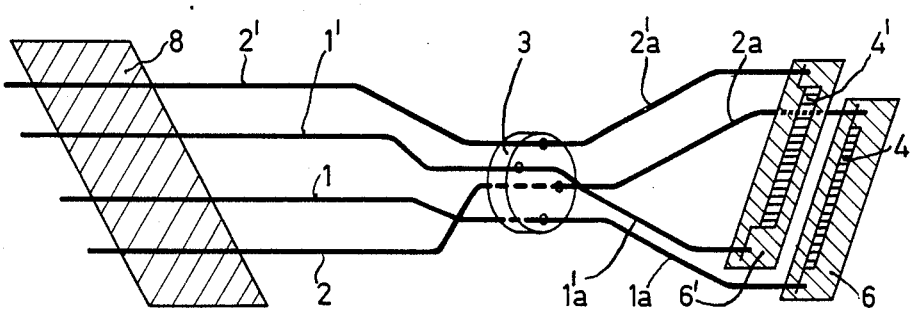
Figure 6:
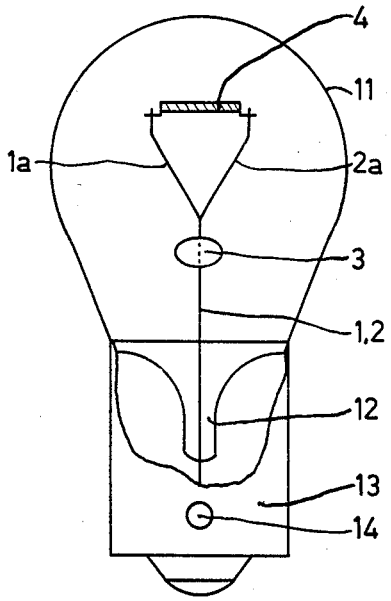
Figure 7:
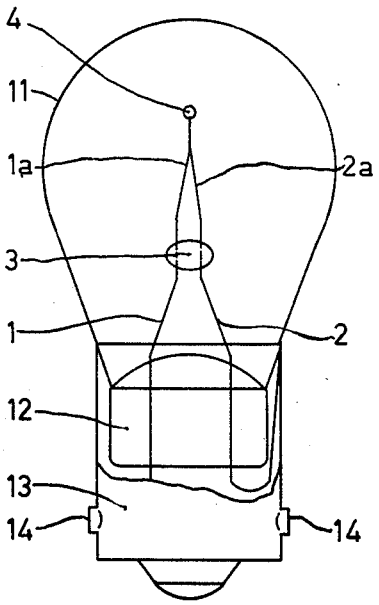
Figure 8:
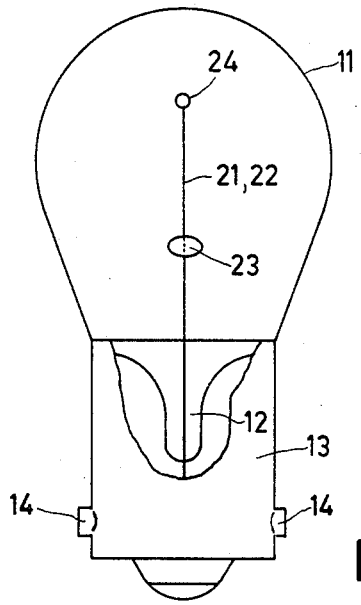
Figure 9:
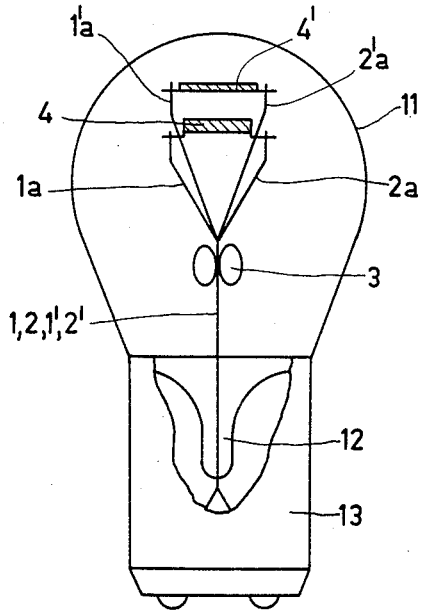
Figure 10:
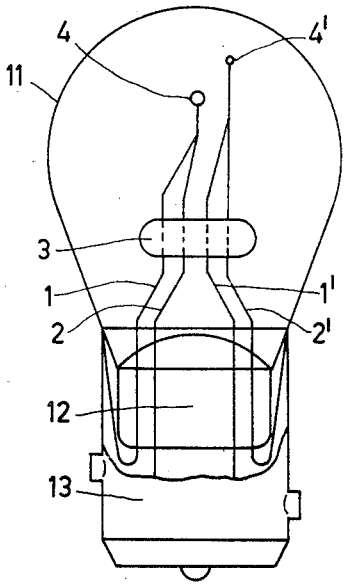

Embodiments of the lamp according to the invention will now be described in greater detail with reference to the accompanying drawing, in which FIG. 1 shows the bead mount of a known incandescent lamp, FIG. 2 shows the bead mount of an incandescent lamp according to the invention havng a plane in which the current supply wires lie in the pinch seal which is rotated 90° with respect to the filament axis, FIG. 3 shows the bead mount according to FIG. 2 with a beam-shaped electrically insulating member and two additional supporting poles, FIG. 4 shows the bead mount according to FIG. 3 but with two parallel filaments and a plane in the pinch seal extending perpendicularly thereto, FIG. 5 shows the bead mount according to FIG. 4 with a disk-shaped insulating member in which the current supply wires are held in a square formation, FIG. 6 is a side elevation of an incandescent lamp with the bead mount shown in FIG. 2 and the lamp cap partly broken away, FIG. 7 is the elevation of the lamp shown in FIG. 6 rotated through 90° about the lamp axis, FIG. 8 is an elevation of the known lamp with the mount of FIG. 1 having the lamp cap partly broken away, FIG. 9 is a side elevation of an incandescent lamp with the bead mount shown in FIG. 4 and the lamp cap partly broken away, and FIG. 10 is an elevation of the lamp shown in FIG. 9 rotated through 90° about the lamp axis with the lamp cap partly broken away.

The bead mount of a known incandescent lamp shown in FIG. 1 consists of two current supply wires 21 and 22 which are held by an electrically insulating member 23, for example glass, and at their ends have a coiled filament 24 whose axis 25 lies in a plane 26. The ends of the current supply wires 21 and 22 remote from the filament 24 lie in a plane 27 which lies in the pinch seal. The main direction of vibration when using the lamp in the normal position in motor cars is denoted by X—X.

The resonant frequency of this bead mount between the plane 27 and the axis 25 of the filament 44 in known 21 Watt stoplight lamps (24 volts) for motor cars, for example, is 300 to 700 Hertz and the resonant frequency of the filament 24 lies in the range from 150 to 350 Hz. Hence the resonant frequency ranges of the bead mount and the filament partly overlap and this leads to superposition oscillations such that the filament may fracture prematurely.

In the bead mount of a lamp according to the invention shown in FIG. 2 the current supply wires 1 and 2 in the pinch seal lie in a plane 8. The wire sections 1*a* and 2*a* of the current supply wires 1 and 2 present between the electrically insulating member 3 and the filament 4 are however rotated through 90° in a plane of rotation 9 extending perpendicularly to the plane 8 and parallel to the axis 5 into the plane 6, in which plane 6 they are secured to the filament 4. The wire sections 1*b* and 2*b* of the current supply wires 1 and 2 lying beside each other in the main direction of vibration X—X between the plane 8 and the electrically insulating member 3, form together with the electrically insulating member 3, a rigid assembly which will substantially not resonate at the frequencies which are critical for motor car lamps. By shifting the electrically insulating member 3 in the longitudinal direction of the current supply wires 1 and 2, the resonant frequency of said wire sections 1*a* and 2*a* (for example 1200 to 1400 Hz) can be made so as to differ considerably (for example more than three times) from the resonant frequency of the filament 4 (150 to 350 Hz). As a result of this no superpositions of the resonant frequencies of the bead mount and the filament can occur.

The bead mount shown in FIG. 3 corresponds essentially to that of FIG. 2 except that the electrically insulating member 3 is elongated, for example a glass rod. Between this elongated electrically insulating member 3*a* and the plane 8 lying in a pinch seal, two additional supporting wires 10 are provided which are sealed both in the said pinch seal and in the electrically insulating member 3*a*. This increases stiffnes of the mount.

As shown in FIG. 4, the bead mount comprises four current supply wires 1, 2 and 1', 2', respectively, for holding two filaments 4 and 4' which are arranged in the planes 6 and 6' parallel to each other, which wires extend parallel to each other between the plane 8 and the elongated electrically insulating member 3*a*, while their wire sections 1*a*; 2*a* and 1'*a*, 2'*a* respectively, present behind the electrically insulating member 3 are rotated through 90° into the planes 6 and 6' respectively.

In the bead mount as shown in FIG. 5 having likewise two filaments 4 and 4' arranged parallel to each other in parallel planes 6 and 6', the four current supply wires 1, 2 and 1', 2', respectively, lie in a plane 8 perpendicular to the planes 6 and 6' and are held in a square formation in a disk-shaped electrically insulating member 3 in such manner that their sections 1*a*; 2*a* and 1'*a*, 2'*a*, respectively, between the electrically insulating member 3 and the filaments 4 and 4', lie in the two planes 6 and 6'.

FIG. 6 and 7 show an incandescent lamp for motor vehicles having a bead mount as shown in FIG. 2. This bead mount is accommodated in a lamp envelope 11 which is sealed by a pinch seal 12 in which the current supply wires 1 and 2 are sealed. The lamp envelope 11 comprises a so-called Swan cap 13 to the contacts of which the current supply wires 1 and 2 are connected. The studs 14 of the cap 13 determine the position of the lamp in a lamp holder and are on a line perpendicular to the longitudinal direction of the filament 4.

FIG. 8 shows a conventional motor car lamp with the mount of FIG. 1. The projections 14 of the cap 13 are in one line perpendicular to the longitudinal direction of the filament 24. When comparing the lamp shown in FIG. 7 with the known lamp shown in FIG. 8 it can be seen that the filaments 4 and 24, respectively, occupy the same position with respect to the projections 14, and hence also when placed in the same lamp holder. From this it appears that when the filament 4 is rotated through an angle of +90° with respect to the pinch seal 12 as compared with the filament 24, the lamp cap 13 in FIG. 7 compared with the lamp cap 13 in FIG. 8 is rotated over an angle of −90° with respect to the pinch seal 12. So the mount of the lamp of FIGS. 6 and 7 is not twisted to give the filament another burning position.

FIGS. 9 and 10 show an incandescent lamp having a bead mount as shown in FIG. 4 with two filaments 4 and 4' extending parallel to each other. The four current supply wires 1, 2 and 1', 2' are again sealed in a pinch seal 12 of the lamp envelope 11. Opposite to the wire sections sealed in the pinch seal 12 the wire sections 1*a'*, 2*a* and 1'*a*, 2'*a*, respectively, extending behind the electrically insulating member 3 are again rotated through 90° and in this position are secured to the filaments 4 and 4', respectively, which during operation in normal position of the lamp assume a horizontal position.

What is claimed is:

1. An electric incandescent lamp for operation in an environment producing vibration in a given direction perpendicular to a lamp holder axis, comprising a lamp envelope defining an envelope axis, and having a pinch seal, at least one helically wound substantially rectilinear filament disposed within said envelope, defining a filament axis, said filament axis being perpendicular to said envelope axis, and said filament and envelope axes defining a filament plane in which the filament axis lies and which is parallel to said envelope axis, at least first and second current supply conductors which pass through said pinch seal and are connected to and support said at least one filament, said current supply conductors defining a first plane where they pass through the pinch seal, said filament plane having a given orientation with respect to said first plane, an electrically insulating member disposed within said envelope and spaced from said pinch seal, said current supply conductors passing through said member between the pinch seal and the filament, said member being fixed to and supported by said conductors, portions of said current supply conductors and said insulating member thereby functioning as a mount for supporting said filament; and a lamp cap fixed to said envelope, for mounting the lamp in a lamp holder with the envelope axis parallel to a lamp holder axis, and comprising means for cooperating with the lamp holder to orient the cap in not more than two predetermined angular positions about the lamp holder axis, said predetermined positions being 180° apart and selected such that said filament plane is perpendicular to said given direction of vibration, characterized in that between the insulating member and the filament said first and second conductors are twisted through an angle of at least 45° with respect to each other about the envelope axis, and said filament plane makes an angle between 45° and 135° with respect to said first plane.

2. A lamp as claimed in claim 1, characterized in that at least portions of said first and second conductors adjacent the pinch seal, between the pinch seal and the insulating member, lie in said first plane; and portions of said conductors adjacent to said filament lie in said filament plane.

3. A lamp as claimed in claim 1, characterized in that said first and second conductors lie in a plane substantially parallel to said first plane where they pass through said insulating member.

4. A lamp as claimed in claim 1, characterized in that, in the direction perpendicular to the filament plane, said mount has a resonant frequency substantially greater than the resonant frequency of the filament in the same direction.

5. A lamp as claimed in claim 4, characterized in that said mount resonant frequency is at least three times the filament resonant frequency.

6. A lamp as claimed in claim 4, characterized in that said insulating member is supported solely by elements lying in said first plane.

7. A lamp as claimed in claim 1, characterized in that said insulating member is supported solely by elements lying in said first plane.

8. An electric incandescent lamp for use in an automotive lamp holder having a horizontal lamp holder axis, comprising a lamp envelope defining an envelope axis, and having a pinch seal, at least one helically wound substantially rectilinear filament disposed within said envelope, defining a filament axis, said filament axis being perpendicular to said envelope axis, and said filament and envelope axes defining a filament plane in which the filament axis lies and which is parallel to said envelope axis, at least first and second current supply conductors which pass through said pinch seal and are connected to and support said at least one filament, said current supply conductors defining a first plane where they pass through the pinch seal, said filament plane having a given orientation with respect to said first plane, an electrically insulating member disposed within said envelope and spaced from said pinch seal, said current supply conductors passing through said member between the pinch seal and the filament, said member being fixed to and supported by said conductors, portions of said current supply conductors and said insulating member thereby functioning as a mount for supporting said filament; and a lamp cap fixed to said envelope, for mounting the lamp in a lamp holder having a horizontal lamp holder axis with the envelope axis horizontal, and comprising means for cooperating with the lamp holder to orient the cap in not more than two predetermined angular positions about the lamp holder axis, in which predetermined positions said filament plane is horizontal, characterized in that between the insulating member and the filament said first and second conductors are twisted through an angle of at least 45° with respect to each other about the envelope axis, and said filament plane makes an angle between 45° and 135° with respect to said first plane.

9. A lamp as claimed in claim 8, characterized in that at least portions of said first and second conductors adjacent the pinch seal, between the pinch seal and the insulating member, lie in said first plane; and portions of said conductors adjacent to said filament lie in said filament plane.

10. A lamp as claimed in claim 8, characterized in that said first and second conductors lie in a plane substantially parallel to said first plane where they pass through said insulating member.

11. A lamp as claimed in claim 8, characterized in that, in the direction perpendicular to the filament plane, said mount has a resonant frequency substantially greater than the resonant frequency of the filament in the same direction.

12. A lamp as claimed in claim 11, characterized in that said mount resonant frequency is at least three times the filament resonant frequency.

13. A lamp as claimed in claim 11, characterized in that said insulating member is supported solely by elements lying in said first plane.

14. A lamp as claimed in claim 13, characterized in that said elements consist of said first and second conductors.

15. A lamp as claimed in claim 13, characterized in that said first and second current carrying conductors are parallel to each other between the pinch seal and the insulating member, and said elements consist of said first and second current supply conductors and at least one element parallel to said first and second conductors.

16. A duel filament automotive lamp, for use in a lamp holder having a horizontal axis, comprising a lamp envelope defining an envelope axis, and having a pinch seal, first and second helically wound substantially rectilinear filaments disposed within said envelope, defining respective first and second filament axes, said filament axes being perpendicular to said envelope axis, and said filament and envelope axes defining respective filament planes in which the respective filament axes lie and which are parallel to said envelope axis, first, second, third, and fourth current supply conductors which pass through said pinch seal, said current supply conductors being substantially co-planar and defining a first plane where they pass through the pinch seal, said first and second conductors being connected to and supporting said first filament, and said third and fourth conductors being connected to and supporting said second filament, said filament planes having a given orientation with respect to said first plane, an electrically insulating member disposed within said envelope and spaced from said pinch seal, said current supply conductors passing through said member between the pinch seal and the filaments, said member being fixed to and supported by said conductors, portions of said current supply conductors and said insulating member thereby functioning as a mount for supporting said filaments; and a lamp cap fixed to said envelope, for mounting the lamp in a lamp holder having a horizontal lamp holder axis with the envelope axis horizontal, and comprising means for cooperating with the lamp holder to orient the cap such that said filament planes are horizontal, characterized in that at a location between said pinch seal and respective filament, said first and second conductors are twisted with respect to each other through an angle of at least 45° about said envelope axis, and said third and fourth conductors are twisted through an angle of at least 45° with respect to each other about said envelope axis, and said first plane is oriented at an angle of at least 45° from the horizontal.

17. A lamp as claimed in claim 16, characterized in that at the location where they pass through said member, said current supply conductors lie substantially in said first plane; and said first and second conductors are twisted with respect to each other, and said third and fourth conductors twisted with respect to each other, between said member and the respective filament.

18. A lamp as claimed in claim 17, characterized in that said insulating member is supported solely by elements lying in said first plane.

19. A lamp as claimed in claim 18, characterized in that said elements consist of said conductors.

20. A lamp as claimed in claim 16, characterized in that said first and second conductors are adjacent each other where they pass through the pinch seal, are rotated with respect to each other between the pinch seal and the insulating member, and lie substantially in a plane parallel to the filament plane where they pass through the insulating member; and said third and fourth conductors are adjacent each other where they pass through the pinch seal, are rotated with respect to each other between the pinch seal and the insulating member, and lie substantially in a plane parallel to the filament plane where they pass through the insulating member.

21. A lamp as claimed in claim 20, characterized in that said member is supported solely by said conductors.

* * * * *